US005078052A

United States Patent [19]

Brogi

[11] Patent Number: 5,078,052

[45] Date of Patent: Jan. 7, 1992

[54] INFRARED PROXIMITY FUZE WITH DOUBLE FIELD OF VIEW FOR MOVING CARRIER APPLICATIONS

[75] Inventor: Giulio Brogi, Rome, Italy

[73] Assignee: Sistel Sistemi Elettronici S.p.A., Orme, Italy

[21] Appl. No.: 480,096

[22] Filed: Feb. 14, 1990

[30] Foreign Application Priority Data

Feb. 14, 1989 [IT] Italy ..... 47646 A/89

[51] Int. Cl.[5] ..... F42C 13/02

[52] U.S. Cl. ..... 102/213

[58] Field of Search ..... 102/213

[56] References Cited

U.S. PATENT DOCUMENTS

| | | | |
|---|---|---|---|
| 3,942,447 | 3/1976 | Van Orsdel et al. | 102/213 |
| 4,098,191 | 7/1978 | Bagwell et al. | 102/213 |
| 4,185,560 | 1/1980 | Levine | 102/213 |
| 4,195,574 | 4/1980 | MacNeille | 102/213 |
| 4,532,867 | 8/1985 | Mitchell | 102/213 |

*Primary Examiner*—Charles T. Jordan

*Attorney, Agent, or Firm*—Cohen, Pontani & Lieberman

[57] ABSTRACT

Infrared proximity fuze, obtained by joining two infrared IR proximity sensors, preferably of the open field type, which have different fields of view (F.O.V.) so that the target sources presence signal is given by the simultaneous presence of an alarm signal coming from the greater field of view sensor and a time gate generated by an alarm signal coming from the lessor F.O.V. sensor. Given the carrier-to-target movement characteristics and the aperture of the two fields of view it is possible to electronically generate a time gate which rejects false targets (fires, flares, etc.) placed at considerable distances from the line of sight. The system is intrinsically protected against the effects of solar radiation combined with the nutation and precession movements of the carrier because it requires simultaneous signal presence within both fields of view.

The open field fuze signal processor checks for the simultaneous presence of a positive IR signal and of a negative rate of change of the IR signal, both characteristic of an emitter coming out of the sensor F.O.V.

3 Claims, 3 Drawing Sheets

Teta = ATAN(DW/2L)

thin window

INFRARED PROXIMITY FUZE WITH DOUBLE FIELD OF VIEW FOR MOVING CARRIER APPLICATIONS

FIELD OF THE INVENTION

The invention refers to an IR proximity fuze which is made up of two independent proximity sensors having different fields of view and of a controlling logic which activates an effective trigger signal for the further firing circuits only when in the presence of a gate signal generated by the lesser F.O.V. sensor and of a trigger generated by the greater F.O.V. sensor.

BACKGROUND OF THE INVENTION

Currently known solutions related to proximity fuzes for airborne targets may be divided into two classes according to whether there is or is not more or less cylindrical symmetry of the sensor compared to the line of sight.

Non-symmetrical sensors, exclusively adopted on rotating carriers (spin stabilized shells or rolling missiles), because of their construction, cannot use other than time and/or spectral filtering for the rejection of false spatial and angular fixed signals, since the sensor field of view monitors different areas of the field continuously due to the rotation required to cover all possible intercept angles. Symmetrical layer-type sensors have a F.O.V. between two angles, Alfa 1 and Alfa 2 in reference to their axis.

Such sensors do not present any fixed-angle (very far) target rejection problem, unless the angle is close to Alfa 1 and/or Alfa 2 and unless the carrier precession and nutation movements move the source in and out of the field of view.

The rejection of relatively far fixed-space targets, however, is nonetheless impossible to achieve due to the fact that the detected signal duration depends on relative speed, on the cross range and on target dimensions.

Open field proximity sensors are symmetric sensors similar to the layer type, but characterized by one single Alfa 1 angle (Alfa 2 may be considered tending to 0), and they exploit, for detection purposes, the peculiar shape of a closing-in target IR signal (a saw-tooth with a slow risetime and sharp flyback).

False alarms due to fixed angle sources can thus be eliminated, but sensitivity to relatively far and sufficiently radiating fixed space sources remains a problem.

Therefore, it would be highly advantageous to provide a system which can effectively target while rejecting false IR signals from both fixed angle sources and spatially fixed sources.

OBJECTS AND SUMMARY OF THE INVENTION

The invention refers to an IR proximity fuze which is made up of two independent proximity sensors having different fields of view and of a controlling logic which activates an effective trigger signal for the further firing circuits only when in the presence of a gate signal generated by the lesser F.O.V. sensor and of a trigger generated by the greater F.O.V. sensor.

The range of applications of such a fuze is within the missile avionic field, and more precisely it is that of the generation of trigger pulses to a missile or a shell pyrotechnic chain for anti-aircraft applications.

The main feature of the invention is the total cancellation of sources (such as fires, the sun, etc.) faraway from the sensor line of sight, which are usually identified as the main cause for false alarms in such sensors.

Another application is contemplated, and this is achieved by placing two of such sensors along the line of flight at suitable distance and connecting them to a central computer. When used with a suitable ground-based IR references source, the system can provide the altitude and the true speed (referred to ground) of an airborne platform.

Second, the time difference between the different fuze F.O.V. sensor outputs may be used to determine the minimum distance of the sensor symmetry line, once the relative speed is known.

Such relative speed can be determined through the time interval between the outputs of two identical sensors set at a given distance along the carrier line of flight.

The inventive solution regards the use of two similar proximity sensors, except for the field of view of one which is less than that of the other: in symbolic notation we have teta 1>teta 2. If the emitter is assumed as a point moving at relative speed $V_t$ against the sensor along a line parallel to the axis of the vector itself, for the trigger times of the two sensors, calculated at the time of crossing the emitter, the following equations apply:

$$T\,1 = MD/Vt/TAN\ (Teta\ 1)$$

$$T\,2 = MD/Vt/TAN\ (Teta\ 2)$$

where MD is the minimum cross range between sensor and emitter, also known as miss distance.

Therefore the delay between the two signals takes the form:

$$Dt = T1 - T2 = MD/Vt * (1/TAN\ (Teta\ 1) - 1/TAN\ (Teta\ 2))$$

This time interval can be used to discriminate spatially fixed sources which are a minimum cross distance greater than the maximum range expected for effective operation of the device herein described, thus ensuring that fires, flares, etc. are effectively rejected.

Additionally, the equipment is totally insensitive to fixed angle sources (the sun, etc.) because the sensor requires activation of both fields of view within a short time interval, which is incompatible with the carrier dynamic characteristics. This analysis may be expanded to include extended sources or non coplanar parallel close-in geometrics, with resulting operational characteristics identical to those shown above.

It is therefore an object of the invention to provide a proximity fuze with a double field of view which can provide reliable triggering while rejecting fixed angle IR sources.

It is a further object of the invention to provide such a fuze as described above which can additionally reject spatially fixed, non-target IR sources to provide further targeting reliability.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
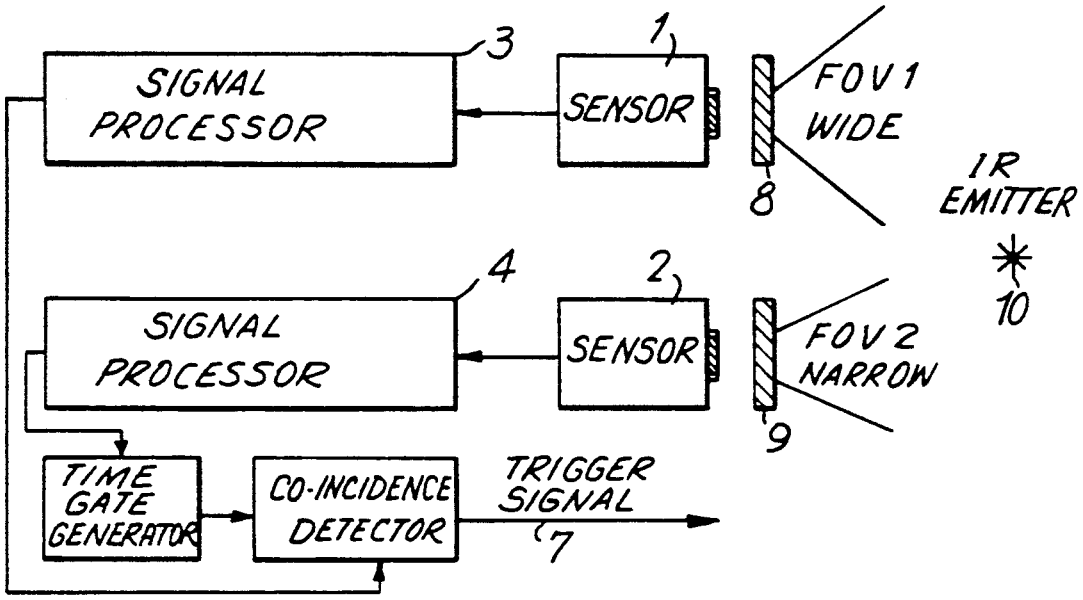
FIG. 1 shows the outline schematic of the fuze.

The double field of view IR proximity sensor is shown schematically in FIG. 1 in a preferred embodiment relating to antiaircraft missile or projectile applications.

Figure 2:
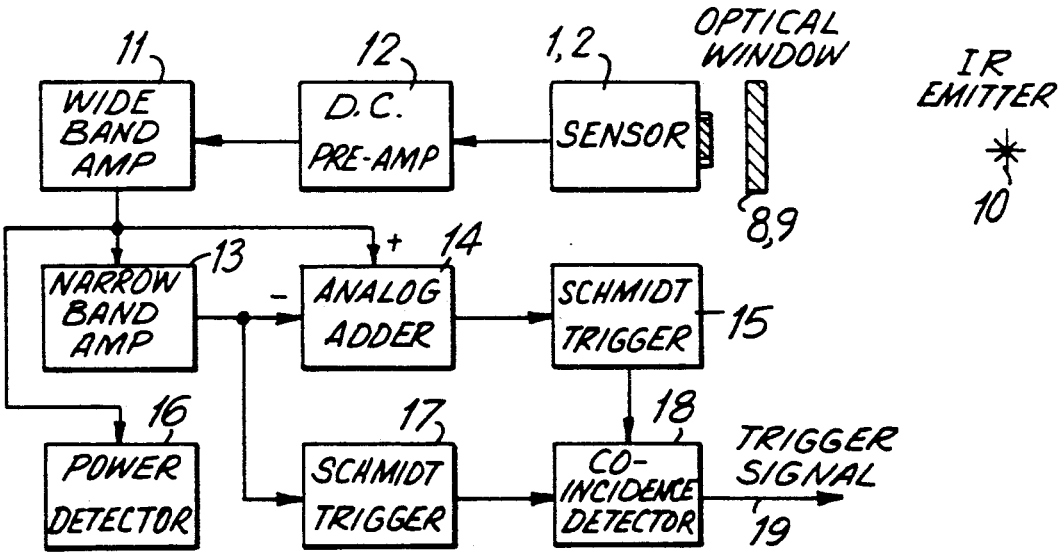
FIG. 2 illustrates a detailed schematic of the window unit of the fuze.

It includes two single proximity sensors, seen in greater detail in FIG. 2, which are specifically selected so that the field of view is 50 degrees for the first (wide) and 40 degrees for the second (narrow). Such angular difference is optimized for a 76/62 mm projectile against a sea-skimmer missile, but it is purely indicative, as other intercept geometries can utilize different angles. The operating principles will remain the same regardless of the angles chosen.

Figure 3:
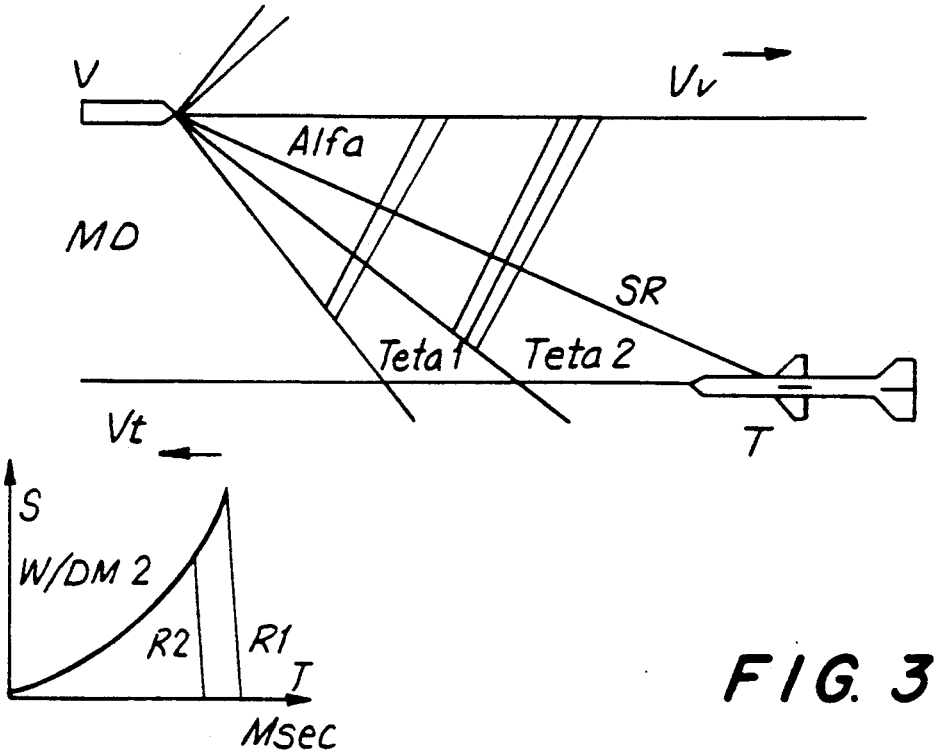
FIG. 3 describes the operating principle of the device in pictorial and graphical form.

The typical intercept geometry for such an operational case is shown schematically in FIG. 3, which also shows the IR signal waveform for the sensors 1 and 2.

Figure 4:
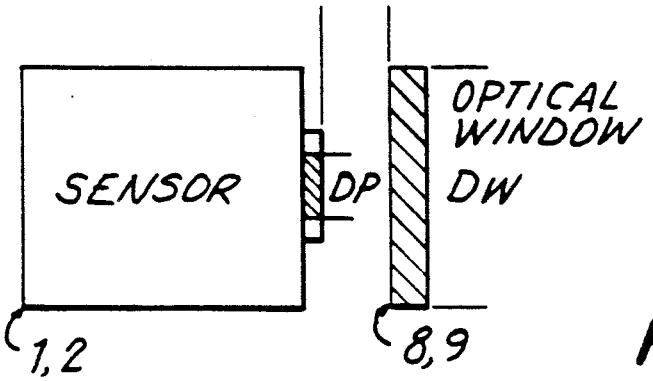
FIG. 4 shows an enlarged drawing of FIG. 1 window details and of the related sensor, and the equations of the field of view Teta for each sensor.

Each single open field sensor 1 or 2 is as shown in FIG. 2, where the IR radiation emitted by the target impinges onto the window (which, as required, may be hermetic, or may be replaced by an optical lens or other suitable IR sensing device), which sets the equipment field of view according to the following relationship (see FIG. 4):

$$Teta = ATAN\ (Dw/2/L).$$

The sensor element 1, 2, which in this case comprises a pyroelectric sensor, converts the IR radiation collected into an electrical current which is amplified by a D.C. pre-amplifier 12 and by a wide band amplifier 11, both shown in FIG. 2.

A narrow-band amplifier 13 provides for low pass filtering of the output electrical signal from amplifier 11. The filtered (narrow band) signal from amplifier 13 is sent to an analog adder 14, which subtracts it from the wide-band signal of wide-band amplifier 11 by differentiation (elimination of the low frequency components of the signal).

The outputs of narrow-band amplifier 13 and wide band amplifier 14 are sent to two threshold comparators, Schmidt triggers 17 and 15, which serve to check that preestablished thresholds of the low pass filtered (positive) signal and the signal derivative (negative) are passed.

A coincidence circuit 18 checks for the simultaneous presence of positive low frequency components and negative high frequency components in the electrical signal, which characterize the signal collected from an emitter located at the field of view border (trigger angle).

With reference to FIG. 1, it can be recognized that the sensors and signal processors 1 and 3 and 2 and 4, are illustrated in greater detail in FIG. 2. They differ solely in terms of field of view amplitude.

FIG. 3 shows how the IR signals received from a target T by each sensor present a trigger point at which there is a sudden decrease of signal amplitude, when the lesser field of view sensor leads the greater field of view sensor by an interval determined by the formula (for symbols refer to FIG. 3):

$$Dt = MD/Vt * (1/TAN\ (Teta\ 1) - 1/TAN\ (Teta\ 2))$$

and by gathering all geometric constants in Kg the formula can be expressed as:

$$DT = Kg * MD/Vt.$$

Therefore an electronic gate generator 5 may be calibrated so that the gate duration is the same as the maximum time interval compatible with the selected operating conditions (expected values for cross range and relative speed).

Figure 5:
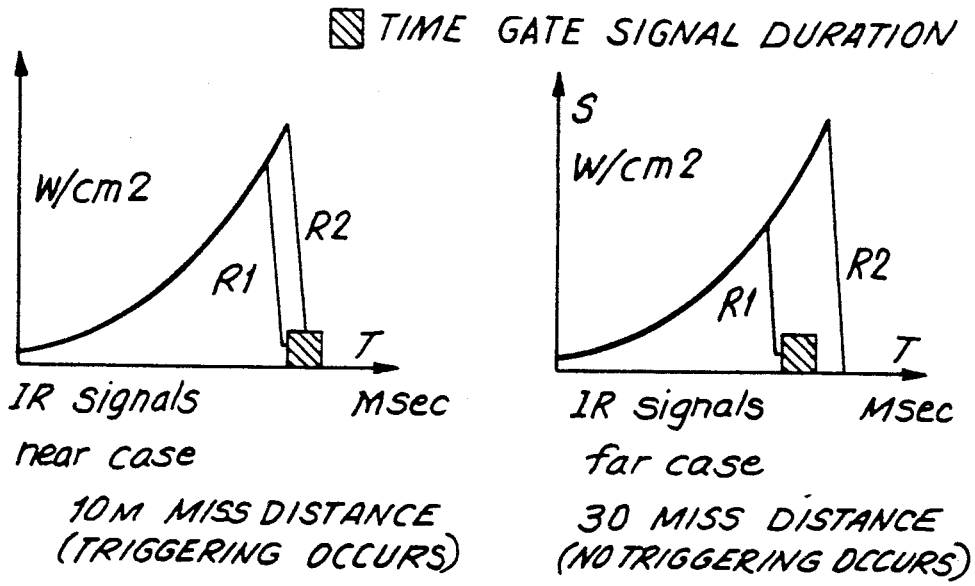
FIG. 5 shows the variation of the IR signal for two operational cases which have the same power acting upon the sensor, but different minimum cross distances.

Fixed targets far from the line of sight are therefore rejected, as shown in the graphs depicted in FIG. 5, where a comparison is made between the signals arriving from a 10 m miss distance emitter (on the left) and those from a ten times more powerful emitter at 30 m miss distance (on the right). It can be seen how the time gate accepts the near signal and rejects the far signal even if their peak signals are similar.

Figure 6:
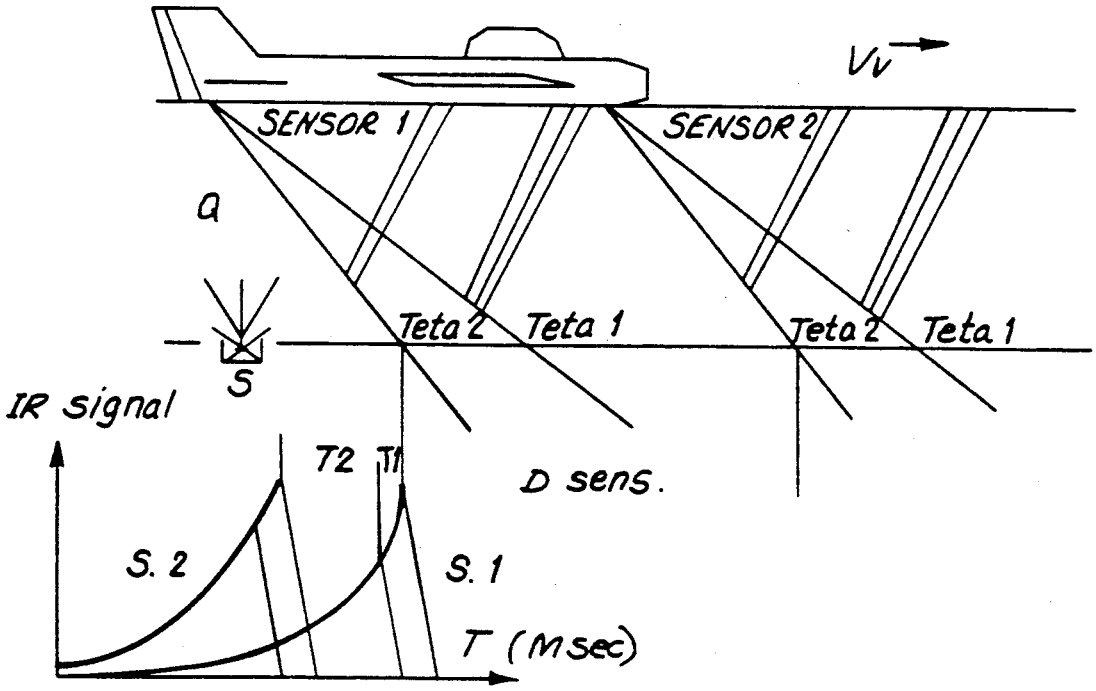
FIG. 6 shows a further applciation which utilizes two sensors for the simultaneous measurement of altitude and speed of an aircraft against a suitable ground based IR source.

An alternative application, that being simultaneous airborne vehicle altitude and speed measurement relative to an emitter set on the ground is shown in FIG. 6, where the time intervals between the two equal field signals on the two sensors (T1) and between the two different field of view signals on one same sensor (T2) are measured.

With reference to FIG. 6, and as the geometric constant Kg defined above shows, it can be seen that the following relationships hold for the ground referenced speed:

$$Vv = Dsens/T1$$

and for speed:

$$Q = Vv * T2/kg.$$

The measurement of both parameters is therefore obtained immediately by adopting digital conversion of the signal and a microprocessor for all calculations required.

The objects of this invention are therefore achieved through the use of time analysis of the signals provided by two proximity sensors having different fields of view.

In its embodiment as a triggering fuze, assuming a maximum operating effective range of the system associated with the proximity sensor and the interval between relative speeds expected, we can calibrate the maximum delay acceptable by the device so as to reject far sources, either natural (such as the sun, fires etc.) or artificial (flares, lasers).

In its alternate embodiment, the simultaneous adoption of two devices of this type, set along the carrier's directional axis, provides for simultaneous measurement of the relative speed and of the miss distance from an emitter, and therefore the invention may be adopted by an airborne vehicle for ground speed and ground altitude measurement.

The invention can therefore be used in various embodiments through the use of two proximity sensors having different field of view, thus enabling comparison data from both sensors to calculate an effective miss distance, or relative speed, or both.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, however, therefor, to be limited only as indicated by the scope of the claims appended hereto.

I claim:

1. An infrared (IR) proximity fuze for use on a moving carrier, comprising;

a trigger;

a trigger circuit for generating a trigger signal;

a first means for sensing IR radiation mounted on said carrier and having a field of view within which IR radiation can be sensed, said first sensing means outputting a first IR presence signal responsive to said IR radiation sensed;

another means for sensing IR radiation mounted on said carrier and having a field of view within which IR radiation can be sensed, said other sensing means outputting an IR presence signal responsive to said IR radiation sensed;

a first means for processing a signal generated by said first sensing means, said first processing means being connected to said first sensing means for receiving said IR presence signal therefrom and for outputting a first information signal responsive thereto for directing the activity of said trigger circuit;

another means for processing a signal generated by said other sensing means, said other processing means being connected to said other sensing means for receiving said IR presence signal therefrom and for outputting a second information signal responsive thereto for directing the activity of said trigger circuit;

said trigger circuit comprising a time gate generator responsive to said first information signal, said time gate generator outputting a gate signal of predetermined duration when said first information signal is received; and means for detecting the coincidental presence of signals, said coincidence detecting means being connected to said time gate generator and to said other signal processing means for receiving said gate signal and said second information signal, said coincidence detecting means being connected to said trigger for outputting to said trigger a trigger signal when the coincidence presence of said gate signal and said second information signal is detected.

2. The fuze according to claim 1, wherein said field of view of said first sensing means and said field of view of said other sensing means are of different sizes from each other.

3. The fuze according to claim 1, wherein said field of view of said first sensing means is of a smaller size than any field of view of any of said other sensing means.

* * * * *